US005474126A

United States Patent [19]

Lynde et al.

[11] Patent Number: 5,474,126

[45] Date of Patent: Dec. 12, 1995

[54] RETRIEVABLE WHIPSTOCK SYSTEM

[75] Inventors: Gerald D. Lynde; Anthony D. Self, both of Houston; Mark H. Lee, Spring, all of Tex.

[73] Assignee: Baker Hughes Incorporated, Houston, Tex.

[21] Appl. No.: 243,340

[22] Filed: May 16, 1994

Related U.S. Application Data

[63] Continuation-in-part of Ser. No. 963,951, Oct. 19, 1992.

[51] Int. Cl.[6] ..... E21B 33/13

[52] U.S. Cl. ..... 166/117.6; 166/382; 175/61

[58] Field of Search ..... 175/61, 62, 73, 175/107, 319; 166/117.5, 117.6, 382, 387

[56] References Cited

U.S. PATENT DOCUMENTS

| | | | |
|---|---|---|---|
| 1,970,761 | 8/1934 | McVicar . | |
| 2,020,471 | 11/1935 | Layne . | |
| 2,173,035 | 9/1939 | Armentrout et al. | 175/61 |
| 2,211,803 | 8/1940 | Warburton . | |
| 2,386,514 | 10/1945 | Stokes . | |
| 2,498,159 | 2/1950 | Gammill . | |
| 2,509,144 | 5/1950 | Grable et al. . | |
| 2,725,936 | 12/1955 | Hester . | |
| 2,882,015 | 4/1959 | Beck et al. . | |
| 3,115,935 | 12/1963 | Hooton . | |
| 3,116,799 | 1/1964 | Lemons | 175/61 |
| 3,118,508 | 1/1964 | Friedman et al. | 175/61 |
| 3,194,327 | 7/1965 | Smithson | 175/61 |
| 3,397,746 | 8/1968 | Link . | |
| 3,398,804 | 8/1968 | Holbert | 175/61 |
| 3,908,759 | 9/1975 | Cagle et al. | 166/117.6 |
| 4,018,274 | 4/1977 | Cochran | 166/129 |
| 4,064,953 | 12/1977 | Collins | 175/321 |
| 4,153,109 | 5/1979 | Szescila | 166/250 |
| 4,285,399 | 8/1981 | Holland et al. | 166/113 |
| 4,304,299 | 12/1981 | Holland et al. | 166/255 |
| 4,319,649 | 3/1982 | Jeter | 175/73 |
| 4,397,355 | 8/1983 | McLamore | 166/297 |
| 4,397,360 | 8/1983 | Schmidt | 175/61 |
| 4,711,326 | 12/1987 | Baugh et al. | 166/212 X |
| 4,750,563 | 6/1988 | Baugh | 166/382 |
| 4,807,704 | 2/1989 | Hsu et al. | 166/313 |
| 4,852,666 | 8/1989 | Brunet et al. | 175/61 |
| 4,887,668 | 12/1989 | Lynde et al. | 166/55.8 |
| 4,978,260 | 12/1990 | Lynde et al. | 166/55.6 |
| 4,984,488 | 1/1991 | Lunde et al. | 166/55.6 X |
| 5,012,877 | 5/1991 | Winters et al. | 175/80 |
| 5,109,924 | 5/1992 | Jurgens et al. | 166/117.5 |
| 5,115,872 | 5/1992 | Brunet et al. | 175/61 |
| 5,154,231 | 10/1992 | Bailey et al. | 166/298 |

(List continued on next page.)

FOREIGN PATENT DOCUMENTS

| | | |
|---|---|---|
| 2033048 | 12/1990 | Canada . |
| 0434924A1 | 10/1990 | European Pat. Off. . |
| 3715900 | 11/1988 | Germany . |
| WO93/03252 | 2/1993 | WIPO . |

OTHER PUBLICATIONS

A-1 Bowen Whipstocks Instruction Manual.

"Christensen Has Everything For Your Drilling and Coring Needs . . . " Brochure, pp. 1658–1699.

Eastman Whipstock articles from 1976–77, 1980–81, 1958–59.

Brown Oil Tools "Husky" H-1RSP Hyudraulic Set Packers With Snap Lock, p. 868 and Handwritten Note.

*Primary Examiner*—Roger J. Schoeppel

*Attorney, Agent, or Firm*—Melvin A. Hunn; Mark W. Handley

[57] ABSTRACT

A whipstock assembly is provided for lowering within a cased wellbore, cutting a window through a casing for drilling a sidetrack borehole, and retrieving with conventional fishing tools. The whipstock assembly includes two separate whipstocks having different tapers, and which are releasibly coupled for separately retrieving from the cased wellbore. A barrier member is provided to prevent a tapered face of one of the whipstocks from wedging debris between the whipstock and the casing.

33 Claims, 11 Drawing Sheets

U.S. PATENT DOCUMENTS 5,163,522 11/1992 Eaton et al. ..... 175/58
5,193,620 3/1993 Braddick ..... 166/382
5,211,715 5/1993 Braden et al. ..... 166/117.5 X
5,222,554 6/1993 Blount et al. ..... 166/117.6
5,277,251 1/1994 Blount et al. ..... 166/117.5
5,311,936 5/1994 McNair et al. ..... 166/50
5,335,737 8/1994 Baugh ..... 175/61

RETRIEVABLE WHIPSTOCK SYSTEM

CROSS REFERENCE TO RELATED APPLICATIONS

This application is a continuation in part of prior U.S. patent application Ser. No. 07/963,951, entitled "Retrievable Whipstock System," and filed on Oct. 19, 1992, which is hereby incorporated by reference as if fully set forth herein.

BACKGROUND OF THE INVENTION

1. Field of the Invention

This invention relates in general to whipstocks for drilling sidetrack boreholes from a wellbore, and in particular to retrievable whipstocks for use in cased wellbores to cut a window laterally through a casing for passing a drillstring to drill a sidetrack borehole.

2. Description of the Prior Art

Prior art whipstocks have been used for drilling sidetrack boreholes from cased wellbores. A prior art whipstock is typically run into a wellbore as part of a whipstock assembly which includes an anchor means for setting at a well depth to support the whipstock within a casing. Several trips into a wellbore are usually required for cutting a window laterally through a side wall of the casing. Once the window is cut laterally through the casing, a drillstring can then be run through the window to drill a sidetrack borehole.

Prior art whipstocks are typically not retrievable with conventional fishing tools, such as conventional spears and overshot tools. Rather, specialized fishing tools are used which can not transmit as much force to the whipstock as can be transmitted with conventional fishing tools. Specialized fishing tools are generally required since typically only the top of the tapered portion of a prior art whipstock is available for latching onto with a fishing tool.

For a whipstock to be retrievable with a conventional overshot tool, the whipstock should be formed with a larger taper, or face angle, than conventional whipstocks. The face angle of a whipstock is the angle between the deflection surface, that is the whipstock face, and the interior surface of the casing. A larger face angle reduces the longitudinal length of the tapered section of whipstock, which provides an upper portion of the tapered section which extends farther about an interior circumference of the casing. A tapered section which extends circumferentially farther about an interior of a casing is easier to latch onto with a conventional overshot tool.

Although a whipstock tapered section having a larger face angle is easier to latch into a conventional fishing tool, a problem arises in that the tapered section does not extend far enough in a longitudinal direction within the casing. This larger face angle and shorter whipstock tapered section results in reducing the longitudinal length of the window which can be cut in the casing with a particular milling tool. If a window does not extend far enough in a longitudinal direction along the casing, then larger diameter and stiffer drillstrings can not be run through the window and into the sidetrack borehole as could be run if the window extended farther in the longitudinal direction.

Prior art whipstock assemblies have only a single deflection surface for cutting a particular window laterally through a casing. This restricts operators to a deflection surface having only a particular face angle. In particular, prior art whipstock assemblies do not include multiple whipstocks for drilling a singular window laterally through a casing.

Milling tools are lowered into wells for engaging with a whipstock surface to cut a window through casing. Prior art full gauge mills can not be run to mill a full gauged window through the casing on a singular trip, but rather are run on subsequent trips after a starting mill is run. As used herein, a full gauge window is a window which is milled using a full gauge milling tool, which is herein defined to be a milling tool having a maximum exterior diameter which is substantially the largest diameter which can be passed interiorly within the casing and still have adequate clearance with the internal casing diameter for tripping within the cased wellbore. An under gauged milling tool is herein defined as a milling tool having a maximum exterior diameter which is significantly smaller than the largest diameter which can be passed interiorly within the casing with adequate clearance for tripping in and out of the wall.

Further, prior art whipstocks typically provide a deflection surface, or whipstock face, having only a singular face angle which extends to an outer diameter of the whipstock. This can result in a section of casing being left adjacent to the downhole portion of the whipstock face after the window is cut. The lower portion of the whipstock and the adjacent section of casing form a space which can trap debris, such as cuttings from the milling operation and other wellbore debris. The deflection surface can then press debris into the casing to wedge the debris between the casing and the whipstock as the whipstock is urged to move uphole.

The section of casing can be left adjacent to the lower end of the whipstock face after cutting a window for two reasons. First, as a window is cut laterally through a casing, the mill can lift off of the deflection surface prior to completing the window and leave a section of the casing adjacent to the lower end of the whipstock face. Second, a milling tool is operated to cut a window by rotating to the right, which is viewed as rotation in a clockwise direction when looking in a downhole direction. As the milling tool is rotated to the right, it will usually walk off of the lower end of the whipstock face in a path which extends in a right hand spiral as the milling tool exits the window, which also leaves a small section of casing adjacent to the lower end of the whipstock face.

As the whipstock is urged to move upwards within a wellbore, the deflection surface is at a face angle to the section of casing. This face angle results in a lateral force component being passed from the deflection surface and to the debris, which presses the debris between the deflection surface and the section of casing. The debris can then become wedged between the whipstock and the casing to stick the whipstock within the casing and prevent removal of the whipstock from the wellbore.

Referring to FIG. 1, a longitudinal section view of a wellbore depicts prior art whipstock 11 within casing 13, through which a mill has cut a window 15 along path 17. As the mill passed along path 17 to cut window 15, the mill lifted off of whipstock 11 to leave a segment 19 of casing 13. Space 21 between segment 19 of casing 13 and whipstock 11 acts as a trap for catching debris 23.

With reference to FIG. 2, a side view of casing 13 and whipstock 11 of FIG. 1 depicts window 15. The edges of deflection surface 25 of whipstock 11 are shown as hidden lines to illustrate how a mill typically walks to the right as it cuts the lower portion of window 15 through casing 13. A mill walking to the right leaves segment 27 of casing 13 adjacent to deflection surface 25 of whipstock 11, even if the mill does not lift off of deflection surface 25 of whipstock 11 prematurely to leave casing segment 19, as shown in FIG. 1.

Referring to both FIG. 1 and FIG. 2, debris 23 can then become trapped within space 21 between deflection surface 25 and adjacent segment 27. Additionally, other debris may become lodged between deflection surface 25 of whipstock 11 and an interior surface of casing 13 as whipstock 11 is moved uphole, besides debris 23 which is trapped in space 21 between whipstock 11 and casing 13 as window 15 is milled, or as the sidetrack borehole is drilled.

When whipstock 11 is urged to move uphole, deflection surface 25 of whipstock 11 urges debris 23 laterally into casing 13 with a lateral force component which arises from deflection surface 25 being disposed at a face angle to an adjacent interior surface of casing 13. In particular, when whipstock 11 is urged to move uphole within casing 13, deflection surface 25 can apply a force to debris which is adjacent to deflection surface 25. This applied force can have a general direction which is normal to the face of deflection surface 25. The force will then have a force component which is in a general direction that is normal to the interior surface of casing 13, that is, which presses the collected debris laterally into the interior surface of casing 13.

SUMMARY OF THE INVENTION

It is one objective of the present invention to provide a whipstock assembly having two whipstock deflection surfaces for use within a wellbore to cut a singular window laterally through a casing.

It is another objective of the present invention to provide a whipstock assembly having two whipstocks which are run into a wellbore together for use to cut a singular window through a casing wall.

It is yet another objective of the present invention to provide a retrievable whipstock assembly having two whipstocks which are run into a wellbore together for use to cut a singular window through a casing wall.

It is still another objective of the present invention to provide a retrievable whipstock assembly having two whipstocks which are run into a wellbore together for use to cut a singular window through a casing wall, at least one of the whipstocks including a barrier means which prevents a tapered section from pressing debris laterally into an interior surface of the casing.

It is further another objective of the present invention to provide a whipstock assembly having a whipstock which includes a barrier member which extends between a tapered section of the whipstock and an interior surface of the casing to prevent the tapered section from pressing debris into the interior surface when the whipstock is urged to move upward within the wellbore.

The above objectives are achieved as is now described. A whipstock assembly is provided for lowering within a cased wellbore, cutting a window through a casing for drilling a sidetrack borehole, and retrieving with conventional fishing tools. The whipstock assembly includes two separate whipstocks which have different tapers, and which are releasibly coupled for separately retrieving from the cased wellbore. A barrier member is provided to prevent a tapered face of one of the whipstocks from wedging debris between the whipstock and the casing.

In a preferred embodiment of the present invention, a whipstock assembly is provided which includes an outer whipstock and an outer whipstock having tapered deflection surfaces which extend at different face angles to the casing. The outer whipstock releasibly secures the whipstock assembly to a workstring and milling tool for lowering and setting within a cased wellbore. The outer whipstock is releasibly coupled to the inner whipstock for separately retrieving from the wellbore. The inner whipstock is secured to a whipstock anchor, which in the preferred embodiment is a retrievable casing packer.

The preferred embodiment further provides an upper portion of the outer whipstock with a cylindrical head for retrieving the outer whipstock with a conventional casing spear. The inner whipstock has a face angle which is larger than those for conventional whipstocks, which provides a larger taper so that the inner the whipstock can be retrieved with a conventional overshot tool. Further, a barrier member provides an exterior surface about the outer whipstock to prevent the tapered face of the outer whipstock from wedging debris between the outer whipstock and the casing.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 3:
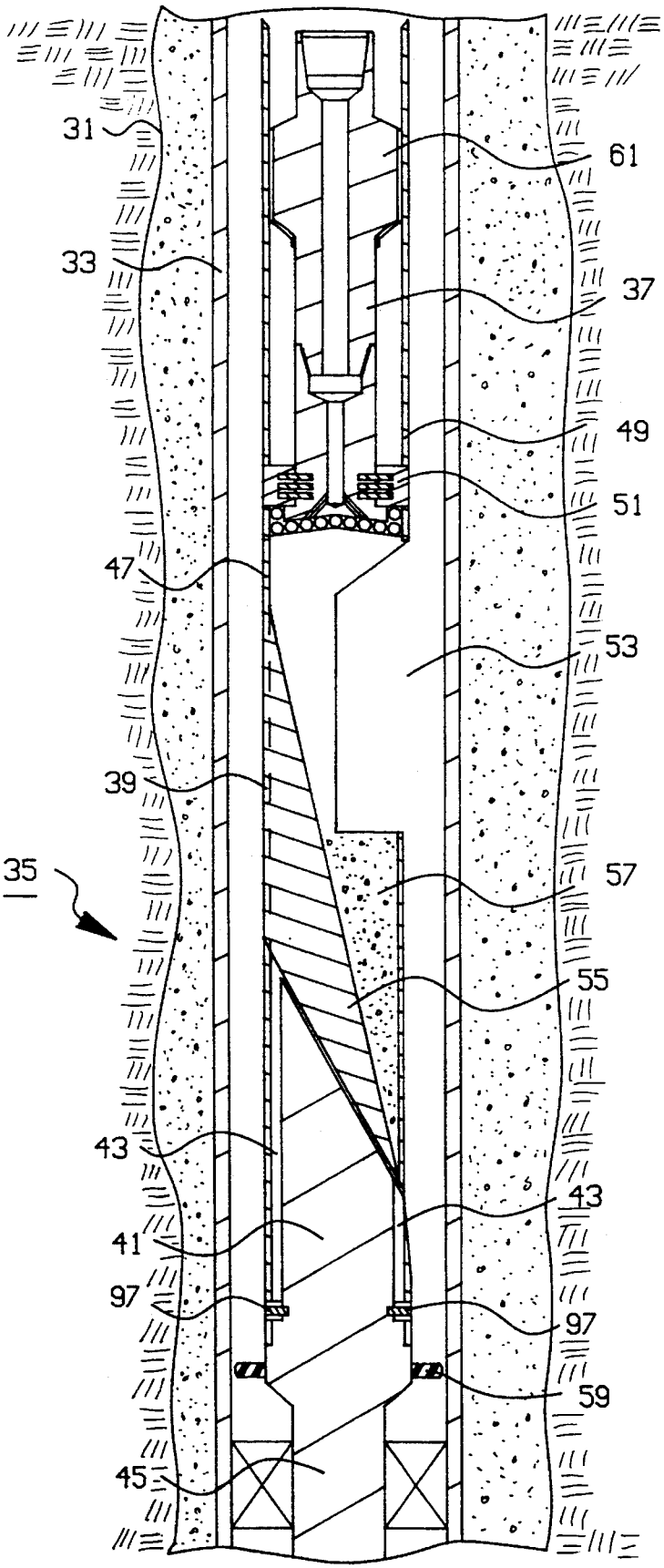
FIG. 3 is a longitudinal section view of a wellbore which depicts the whipstock assembly of the preferred embodiment of the present invention

With reference now to the figures and in particular with reference to FIG. 3, a longitudinal section view of wellbore 31 depicts whipstock assembly 35 set within casing 33. Whipstock assembly 35 includes milling tool 37, outer whipstock 39, inner whipstock 41, whipstock coupling 43, and anchor packer 45. Whipstock coupling 43 releasibly couples outer whipstock 39 to inner whipstock 41. Anchor packer 45 is secured to inner whipstock 41 and provides an anchor means, or whipstock anchor, for releasibly securing inner whipstock 41 within casing 33.

Outer whipstock 39 includes housing 47, which in the preferred embodiment of the present invention is a sleeve formed from a tubular member. The upper portion of housing 47 provides cylindrical head 49. Whipstock assembly release latch 51 releasibly secures milling tool 37 within cylindrical head 49. Opening 53 in housing 47 provides an aperture for passing milling tool 37 from within housing 47. Outer whipstock 39 further includes tapered member 55 which is secured within housing 47.

Barrier member 57 provides a debris barrier and exterior surface for tapered member 55 of outer whipstock 39. Excluder member 59 is secured about an exterior of inner whipstock 41 to provide a debris barrier between inner whipstock 41 and the interior surface of casing 33.

With reference to FIGS. 4*a* through 4*d*, one quarter longitudinal section views of whipstock assembly 35, which is shown in a run-in position, together depict an illustrative, preferred embodiment of the present invention. Milling tool 37 includes watermelon mill 61 and window mill 63. Milling tool 37 is secured within cylindrical head 49 of housing 47 by release latch 51, which in the preferred embodiment of the present invention includes two trip-in lugs 65 and shear pins 67. In other embodiments of the present invention, other types of latches may be used, such as, for example, a hydraulically released latch which is activated by fluid pressure within milling tool 37.

Figure 4A:
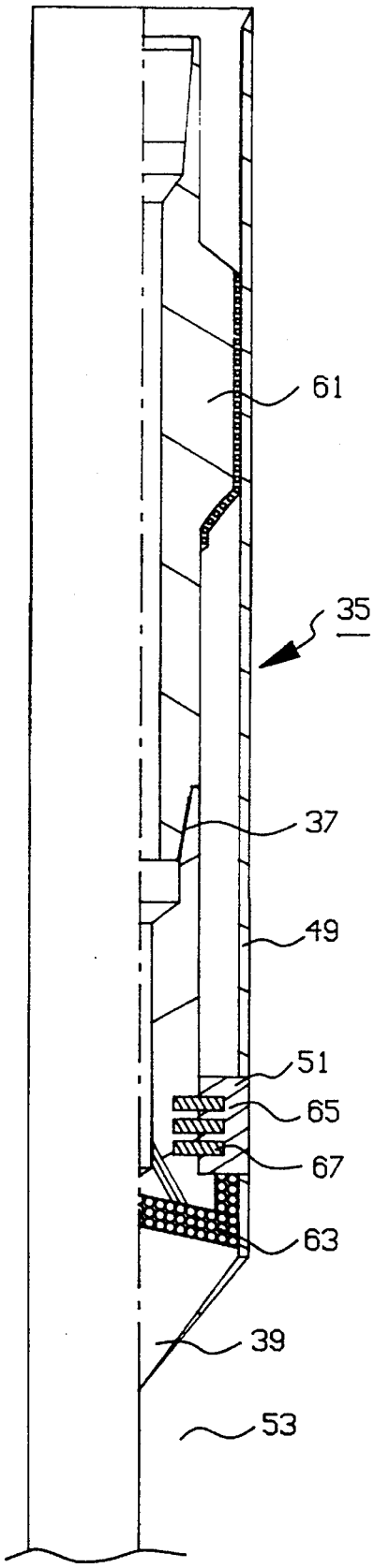
FIGS. 4*a* through 4*d*, are one-quarter longitudinal section views which together depict the whipstock assembly of an illustrative, preferred embodiment of the present invention.
Figure 4B:
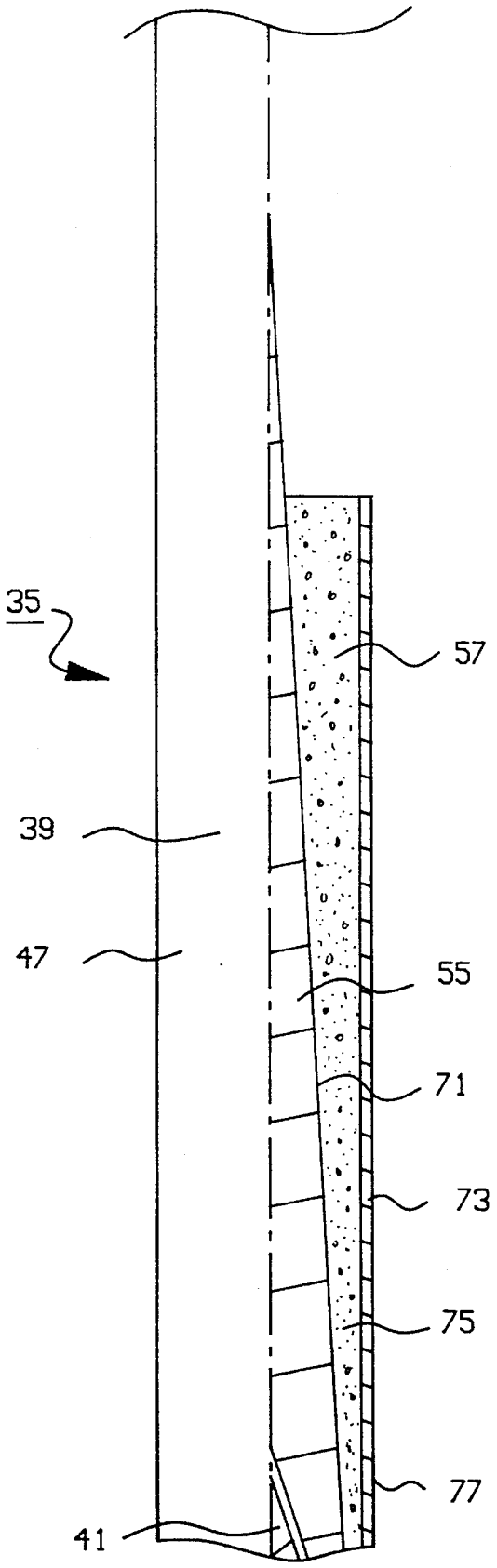
Figure 4C:
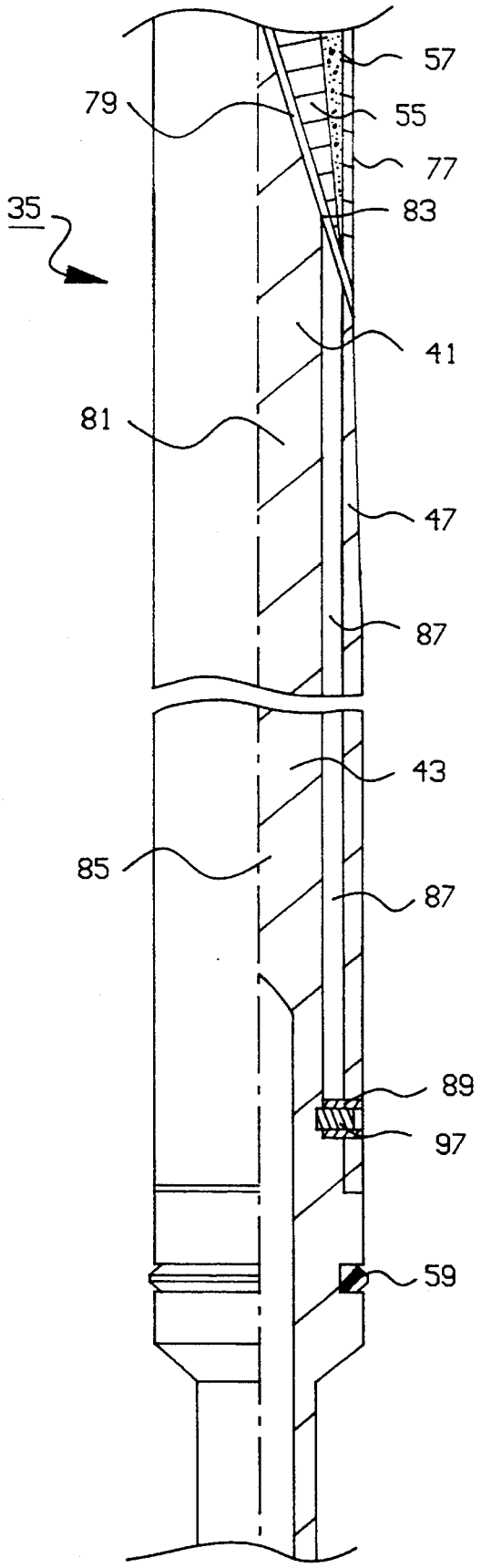

Two trip-in lugs 65 are used in release latch 51, and they are spaced circumferentially separated by 180 degrees about an interior diameter of cylindrical housing 49. Only one trip-in lug is shown in FIG. 4*a*. Trip-in lugs 65 each have a lower shoulder which mates with an upper shoulder of window mill 63 for transferring to whipstock 35 an upwards force, which may exceed the force required to sever shear pins 67. Milling tool 37 is released from within cylindrical head 49 by application of 60,000 pounds of downward force, which severs sheer pins 67. Outer whipstock 39 can be retrieved uphole by engaging window mill 63 with trip-in lugs 65, or trip-in lugs 65 may be milled away for retrieving outer whipstock 39 with a conventional fishing tool, such as a spear. Opening 53 is shown for passing milling tool 37 from within cylindrical head 49.

Outer whipstock 39 further includes tapered member 55 which provides a first deflection surface 71. Deflection surface 71 is a whipstock face, which in the preferred embodiment of the present invention is a concave surface. Barrier member 57 is secured about deflection surface 71 and provides a debris barrier. Barrier member 57 includes thin-walled sleeve 73, which in the preferred embodiment of the present invention is formed from sheet metal. Barrier member 57 further includes cement 75 which fills the space between the interior of thin-walled sleeve 73 and first deflection surface 71. Thin-walled sleeve 73 and cement 75 provide a millable surface which window mill 63 will mill at least a portion of away when used to cut a window laterally into a wellbore casing.

Barrier member 57 further provides outer whipstock 39 with an exterior shape having exterior surface 77, which provides an outer exterior surface for outer whipstock 39 which will be substantially parallel to a wellbore casing when run inside of a wellbore, rather than a tapered surface such as deflection surface 71 of tapered member 55. First deflection surface 71 will be at a face angle to a wellbore casing, rather than parallel to the wellbore casing, as is exterior surface 77. Exterior surface 77 will provide a barrier to prevent deflection surface 71 from wedging debris between a wellbore casing and the face of whipstock 39. Barrier member 57 will also act as a debris barrier to prevent debris from accumulating immediately adjacent to the lower end of deflection surface 71.

In the run-in position, outer whipstock 39 is secured about inner whipstock 41 so that only a small gap 79 is left between the lower end of tapered member 55 and the upper end of tapered member 81.

Inner whipstock 41 includes tapered member 81 which provides a second deflection surface 83. Second deflection surface 83 provides a whipstock face, which is a concave surface in the preferred embodiment of the present invention. Tapered member 81 is secured to coupling mandril 85.

Figure 4D:
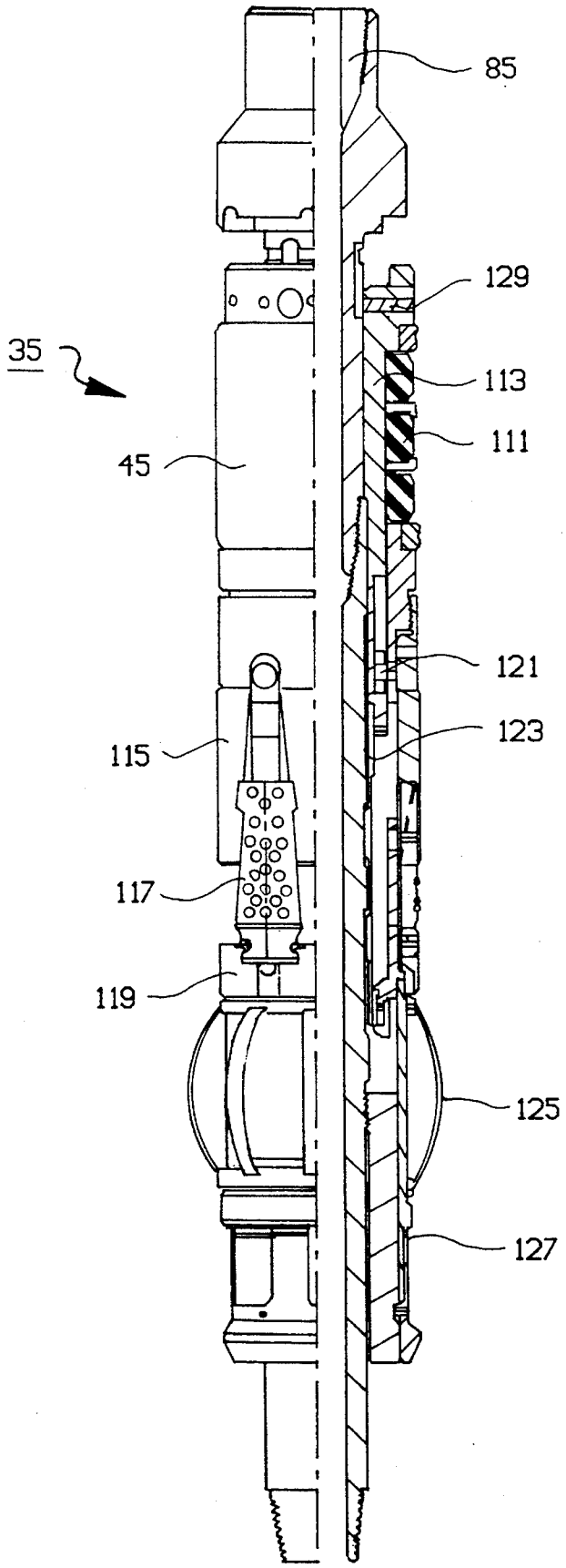

Whipstock coupling 43 includes coupling mandril 85 into which two slots 87 are formed, of which only one is shown in FIG. 4*d*. Slots 87 have a J-type slot profile for receipt of lugs 89 which are welded within housing 47 and included as part of outer whipstock 39. Receipt of lugs 89 within slots 87 secures outer whipstock 39 to inner whipstock 41 for transferring torque therebetween. Shear screws 97 shearably secure outer whipstock 39 to inner whipstock 41 for transferring linear force below a predetermined force threshold.

Figure 1:
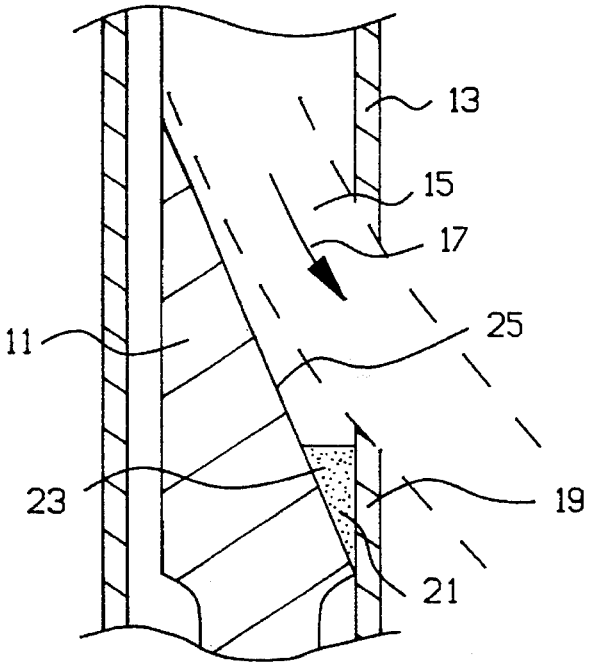
FIG. 1 PRIOR ART
FIG. 1 is a longitudinal section view of a wellbore, and depicts a prior art whipstock which is set within a wellbore casing through which a mill has cut a window along a pathway for drilling a sidetrack borehole.
Figure 2:
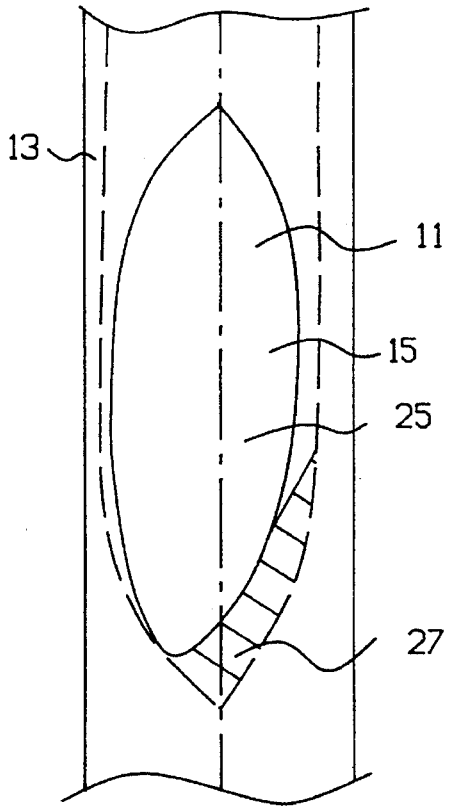
FIG. 2 PRIOR ART
FIG. 2 is a side view of the casing of FIG. 1, and depicts how the window through the casing is not fully aligned with the face of the whipstock since the mill has walked off of the whipstock face with right hand rotation.
Figure 5:
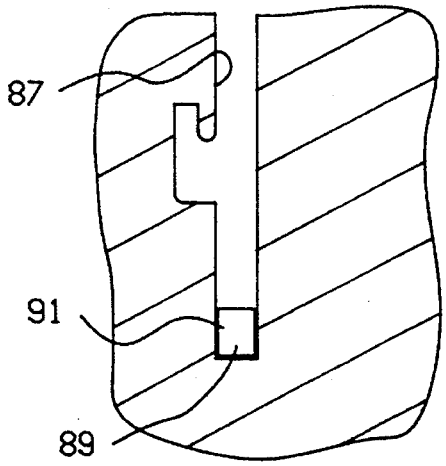
FIG. 5 is a schematic diagram which depicts a development view showing a projection into a flat plane of one of the J-type slots of the whipstock coupling of the preferred embodiment of the present invention.

Referring now to FIG. 5, a schematic diagram depicts one of slots 87 which are formed into coupling mandril 85 of whipstock 43. This is a development view, which shows a flat plan layout of one of slots 87 as if it were to be projected into a flat plane. The profile of slot 87 is that of a J-type of slot. Lugs 89 are traversed from within slots 87 by raising upward from the run-in lug position 91 to release outer whipstock 39 from the inner whipstock 41 in the preferred embodiment of the present invention. J-portion 99 of slot 87 is provided to allow a retrieval tool having a box end within which an interior lug extends for securing into J-portion 99. However, conventional overshot tools may be run for retrieving inner whipstock 41, as discussed below.

Referring again to FIGS. 4*a* and 4*d*, excluder member 59 is an elastomeric element which extends circumferentially around an exterior surface of coupling mandril 85, and will extend laterally towards an interior of a wellbore casing into which whipstock assembly 35 is lowered.

In the preferred embodiment of the present invention, anchor packer 45 provides an anchor means, or whipstock anchor, to releasibly secure inner whipstock 41 within a wellbore casing string. Anchor packer 45 includes packing sleeves 111 which are disposed around packer mandrel 113. Slip seat 115 is provided for engagement with slips 117, which are a part of slip assembly 119. In the preferred embodiment of the present invention, slips 117 and slip seat 115 provide a flex-lock type of slip gripping mechanism. In other embodiments of the present invention, other types of anchor means may be used.

Lock ring 121 is provided for ratcheting engagement with lock sleeve 123, which is a longitudinally slotted sleeve with wicker threads. Drag springs 125 form a lower portion of slip assembly 119. Rotation release latch 127 is utilized to release slip assembly 119 from packer mandrel 113 so that slip seat 115 can be moved downward with respect to slips 117 for setting anchor packer 45 within a wellbore. Shear pins 129 are provided for releasing packer 45 for retrieval from a wellbore. In the preferred embodiment of the present invention, shear pins 129 together sever at 80,000 pounds of force to release anchor packer 45 from within a well casing for retrieval of inner whipstock 41 and anchor packer 45 from a wellbore.

Rotation release latch 127 is disclosed in U.S. Pat. No. 5,311,941, issuing on May 17, 1994, having application Ser. No. 07/928,816, which was filed on Aug. 12, 1992, entitled, "Rotation Release Latch for a Wellbore Tool," invented by John L. Baugh, and further identified by Attorney Docket No. 294-6059-US. U.S. patent application Ser. No. 07/928,816 is hereby incorporated by reference as if fully set forth herein.

Figure 6:
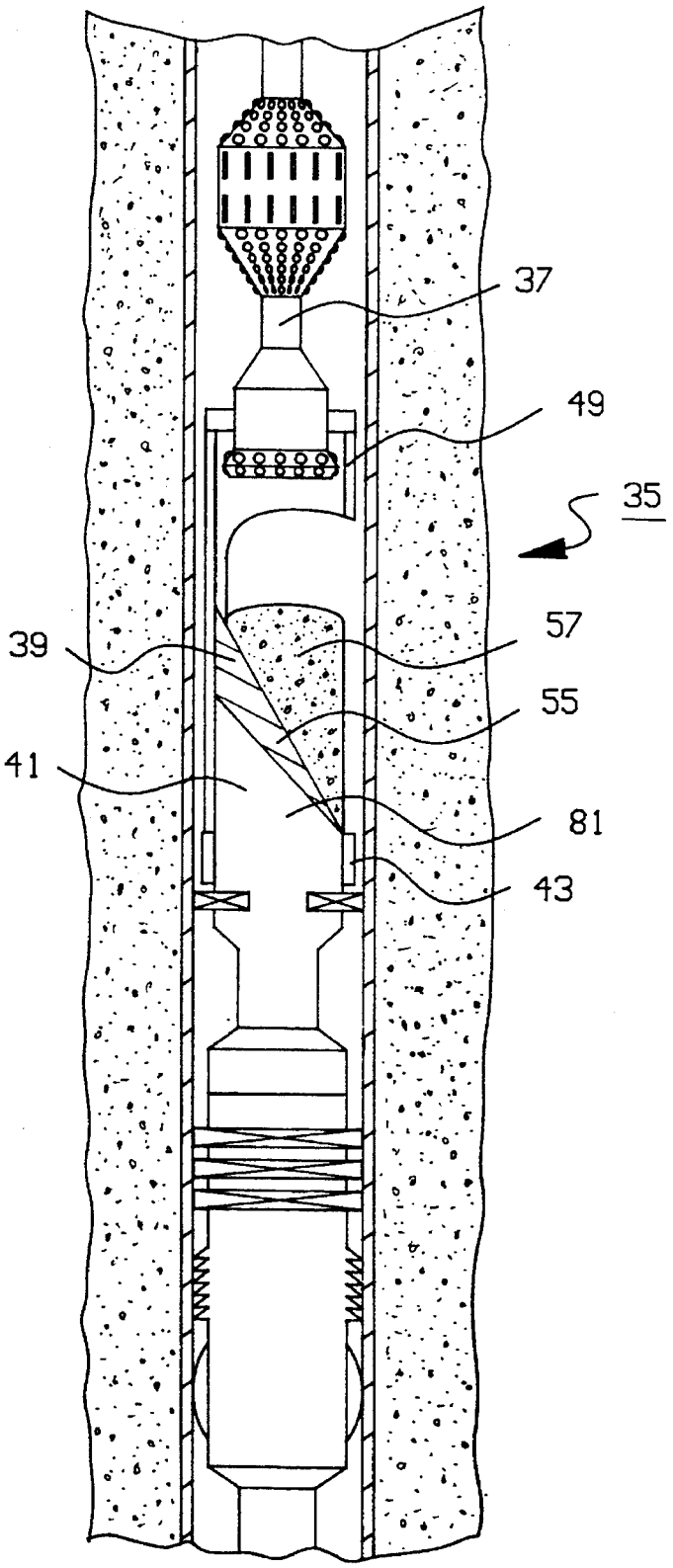
FIGS. 6 through 10 are schematic diagrams which depict operation of the whipstock assembly of the present invention being used to mill a window laterally through a wellbore casing for passing a drillstring to drill a sidetrack borehole.

Operation of whipstock assembly 35 is now described with reference to FIGS. 6 through 10 which are schematic diagrams depicting use of the present invention to mill a window for drilling a sidetrack borehole. Referring now to FIG. 6, whipstock assembly 35 is shown after running into a wellbore and setting anchor packer 45. Milling tool 37 is still shown in the run-in position, secured within cylindrical head 49. Whipstock coupling 43 is also shown in the run-in position. Anchor packer 45 has been set by rotating 360 degrees, positioning whipstock assembly 35 in the proper angular orientation within wellbore 33, and setting weight down to secure anchor packer 45 within casing 33. Milling tool 37 may now be released from cylindrical head 49.

Figure 7:
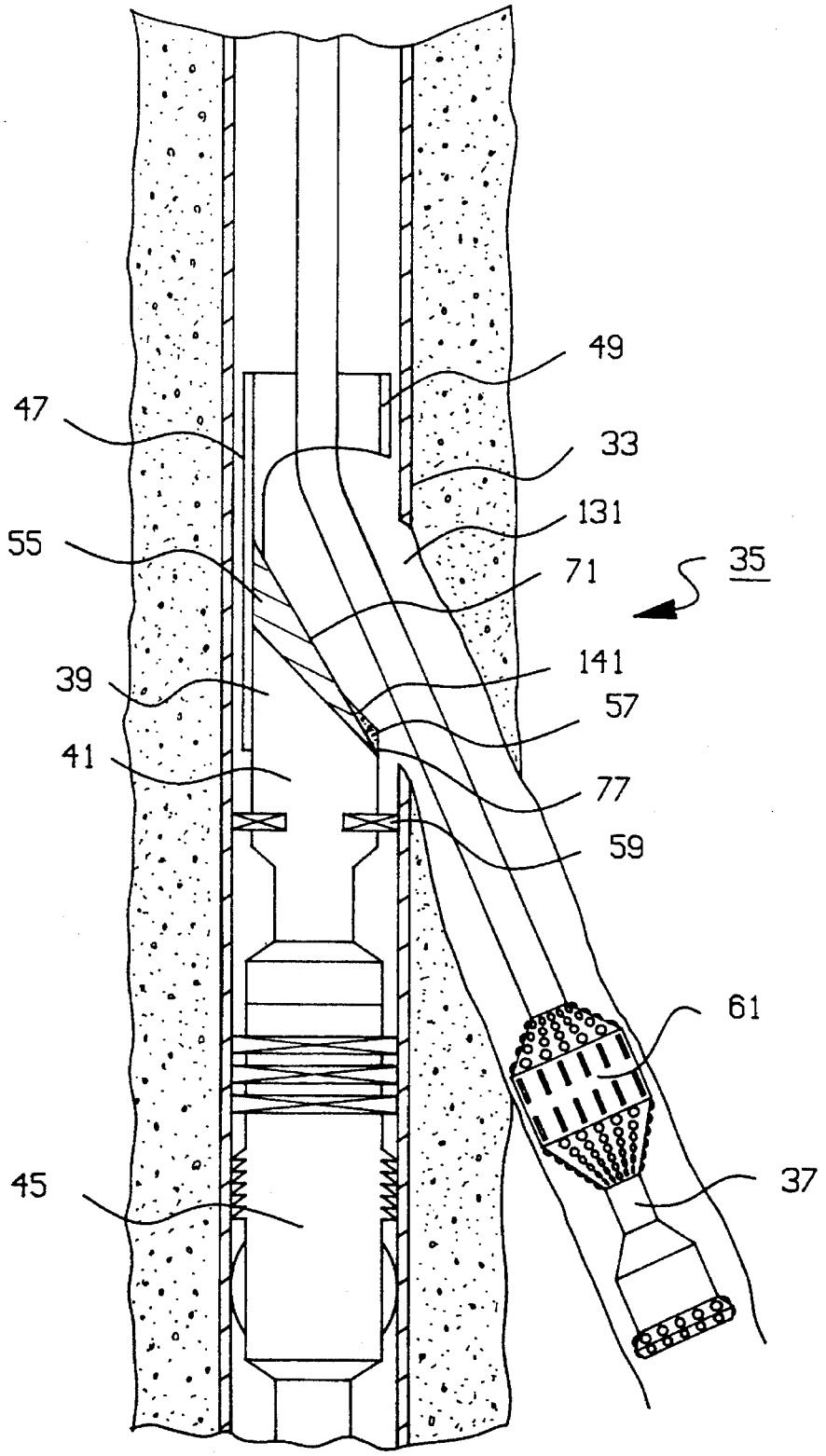

Referring now to FIG. 7, whipstock assembly 35 is depicted after milling tool 37 has been released from cylindrical head 49 and window 131 has been cut through casing 33. Cylindrical head 49 is also shown after lugs 89 (not shown in FIG. 9) have been milled from within housing 47 by milling tool 37. It should be noted that in the preferred embodiment of the present invention, lugs 89 have to be milled prior to cutting window 131 so that watermelon mill 61 will pass through cylindrical head 49. Additionally, milling tool 37 is an under gauge mill so that it will pass through cylindrical head 49 in cutting at least part of window 131, which is under gauge when compared to a full gauge window that could be drilled by use of a full gauge mill.

Figure 8:
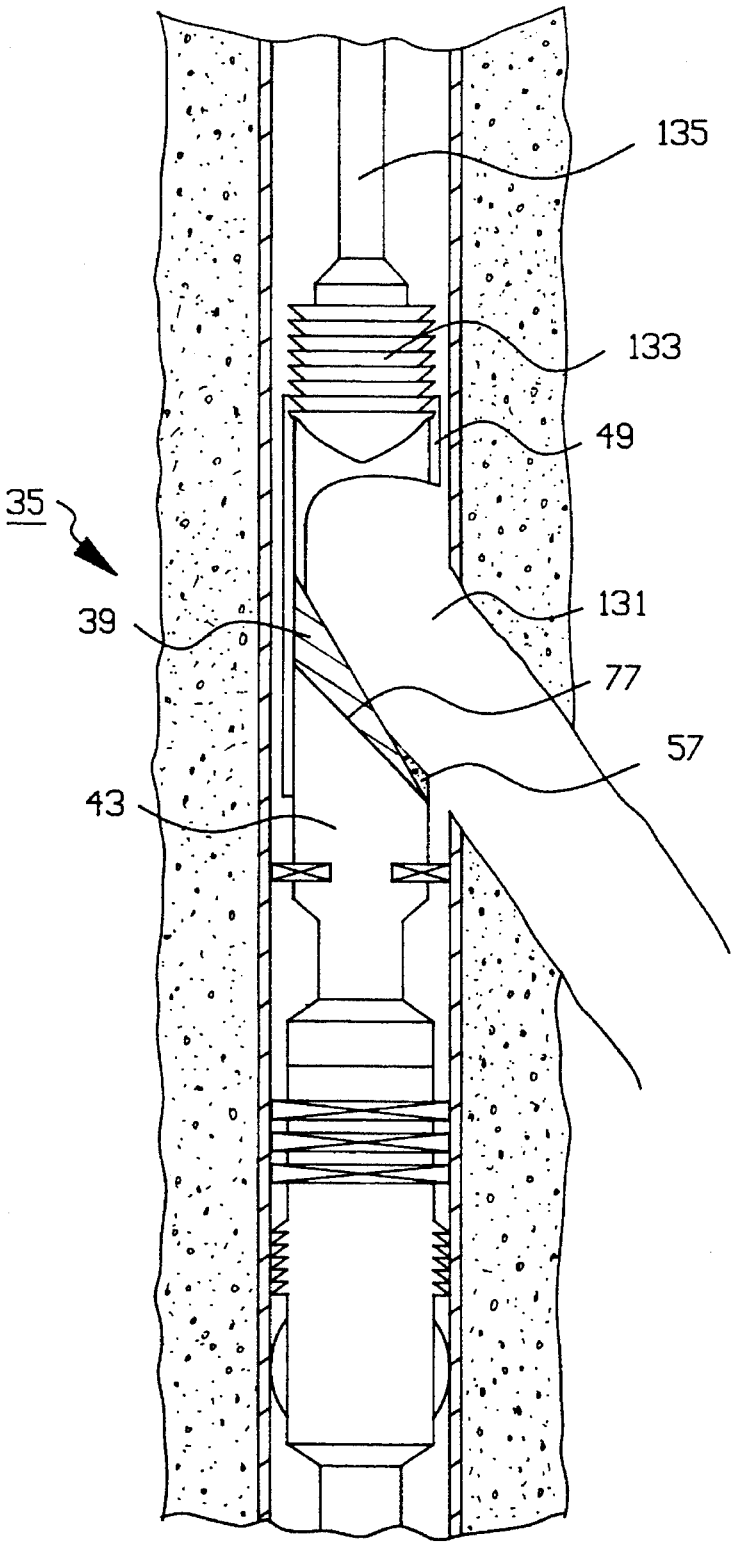

Referring now to FIG. 8, whipstock assembly 35 is shown after the removal of milling tool 37 from the wellbore and running spear 133 back within cylindrical head 49 on workstring 135. Spear 133 is a conventional fishing tool which can be run into the interior of cylindrical head 49 to latch onto and retrieve outer whipstock 39. Shear pins 97 (shown in FIG. 4*c*) are then severed to release whipstock coupling 43 and retrieve outer whipstock 39 from within wellbore 31.

Figure 9:
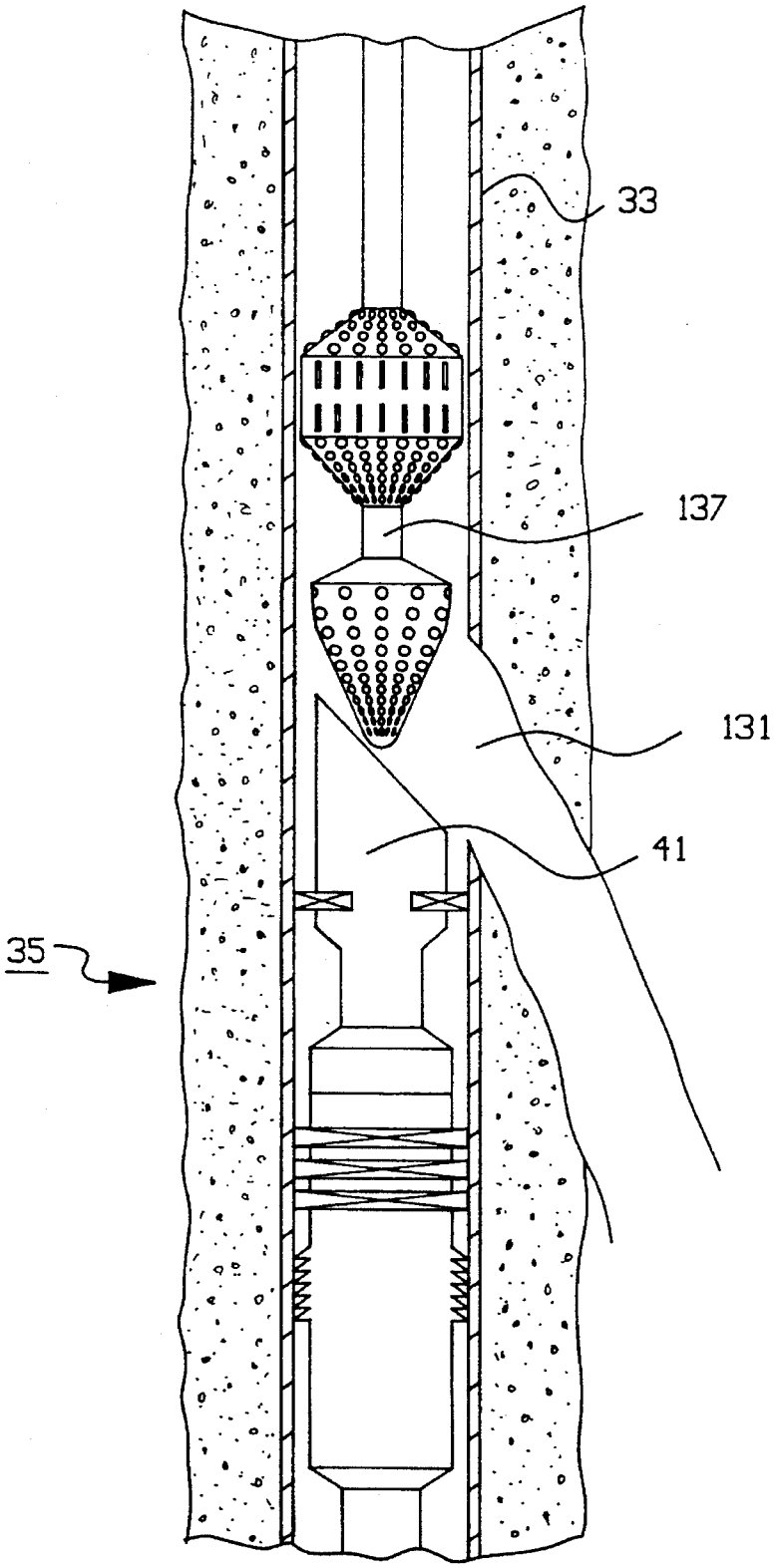

Referring now to FIG. 9, whipstock assembly 35 is shown after the removal of outer whipstock 39 from the wellbore, and full gauge milling tool 137 has been run downhole within casing 33. Full gauge milling tool 137 is then rotated and lowered into inner whipstock 41 for enlarging window 131 to a full gauge window, for accommodation of the substantially largest size drillstring (not shown) which can be reasonably passed within casing 33.

Figure 10:
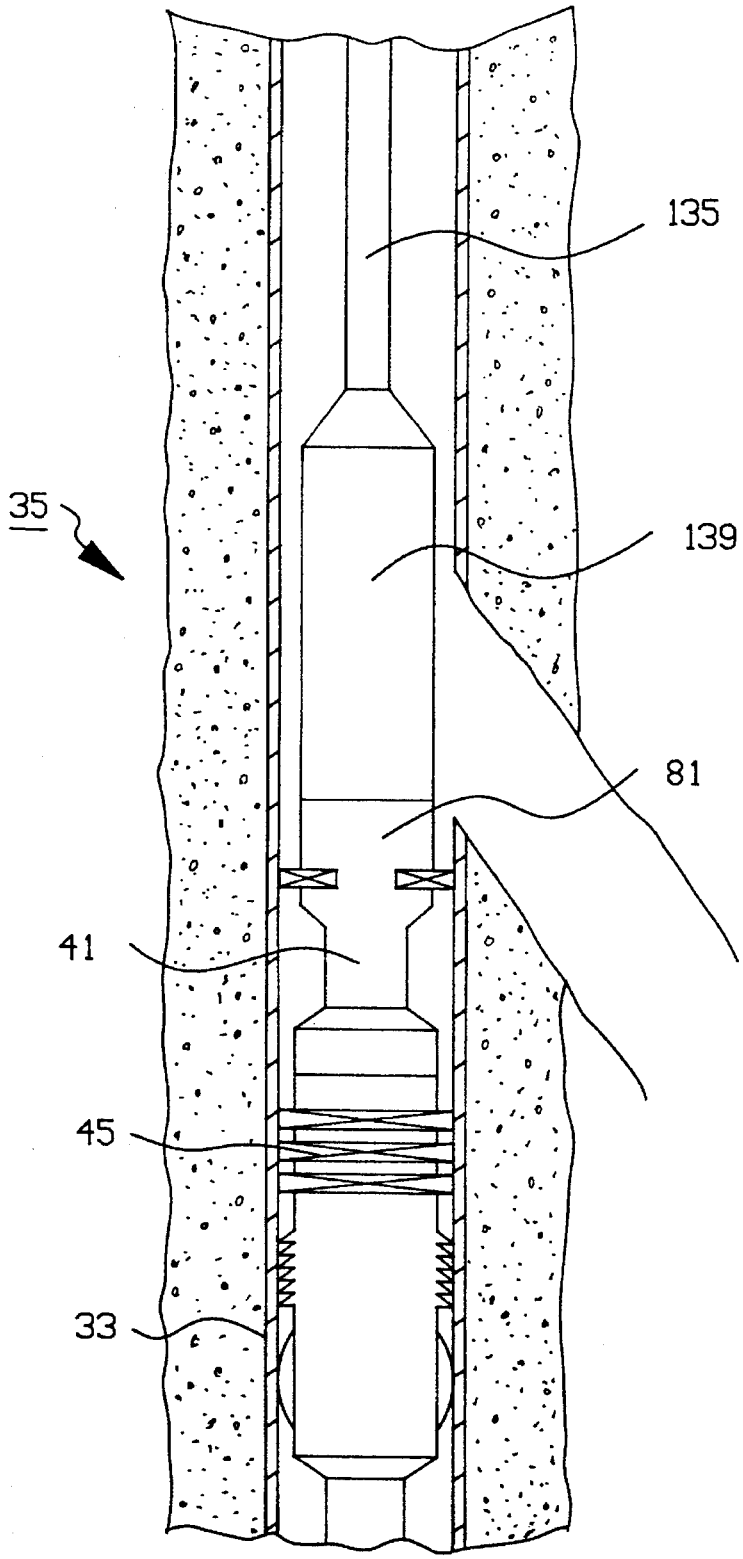

Referring now to FIG. 10, whipstock assembly 35 is shown with overshot 139 secured to tapered member 81 of inner whipstock 41. Since tapered member 81 has a relatively large face angle and smaller outside diameter, as compared to other whipstock face angles and diameters such as, for example, the face angle of tapered member 55 (depicted in FIG. 7), conventional overshot 139 may be used for retrieval of inner whipstock 41. Workstring 135 is then used to pull upwards on inner whipstock 41 and release anchor packer 45 from within casing 33 for retrieval of anchor packer 45 and inner whipstock 41 from wellbore casing 33.

Referring again to FIGS. 6 and 7, it should be noted that barrier member 57 was milled from above tapered member 55 to form an exterior shape 141 of first deflection surface 71, and outer whipstock 39. In other embodiments of the present invention, rather than having a separate barrier member 57, which is a millable member, for milling to form the shape of first deflection surface 71, first deflection surface 72 can be made to integrally include a shape such as that provided by barrier member 57. That is, deflection surface 77 could be formed to have an exterior shape such as exterior shape 141 which extends into an exterior surface 77 for preventing first deflection surface 71 from wedging debris (not shown) between the exterior of whipstock 35 and the interior casing 33.

Additionally, excluder member 59 acts as a debris barrier to prevent wellbore debris, such as cuttings from milling window 131, from lodging around inner whipstock 41 or alongside anchor packer 45.

The whipstock assembly of the present invention offers several advantages over prior art whipstock assemblies. The whipstock assembly of the present invention may be utilized to run two whipstocks in tandem into a wellbore to cut a singular window laterally through the casing. These two whipstocks have different deflection surfaces. The first deflection surface allows an under gauge milling tool to be run which can pass through a cylindrical head providing an upper portion of an outer whipstock so that a casing spear can be used for retrieval of the outer whipstock from the wellbore. Further, the second whipstock provides an inner whipstock having a larger face angle for use with a full gauge mill for milling the window for passage of a drillstring which is full gauge with the interior diameter of the wellbore casing. The smaller face angle of the outer whipstock allows the window to extend for a longer length longitudinally along the casing than could have been drilled with a whipstock having a shorter face angle using the same mill. The larger face angle allows the tapered portion of the inner whipstock to be shorter so that a conventional overshot tool can be used for latching onto the inner whipstock for releasing the anchor packer and retrieving the inner whipstock from the wellbore.

Another advantage of the present invention is that a barrier member is provided which is milled to form the shape of the lower portion of the tapered surface of the whipstock face as the window is being cut. This prevents having a tapered section adjacent to the casing immediately below the window, and thus prevents cuttings from the milling operation from accumulating and being wedged between the whipstock and the interior surface of the casing.

Additionally, another advantage of the present invention is that an excluder member is provided to prevent debris from falling around the whipstock anchor and preventing retrieval from the wellbore.

Yet another advantage of the present invention is that a retrievable whipstock assembly is provided which may be used to mill a full gauge opening laterally through a casing wall to pass a full gauge drillstring to drill a sidetrack borehole, and then the whipstock assembly may be retrieved utilizing conventional fishing tools, such as a spear or overshot tool. The use of conventional fishing tools enhance retrievability of the whipstock assembly since much more force can be exerted with conventional fishing tools than can typically be exerted with specialized fishing tools used with prior art whipstock assemblies for drilling full gauge windows. This allows more force to be applied to pull the whipstock assembly upwards within the wellbore.

Still another advantage of the present invention is that more than one location about the outer whipstock is used for securing the milling tool to the whipstock assembly while the whipstock assembly is run into a wellbore. In the preferred embodiment, two locations are used, separated by 180 degrees for shearably securing the run-in lugs to the window mill. With prior art whipstocks, only one location is used, which may result in the shear members being severed when the tool assembly is flexed during run-in. With the present invention, the mill is shearably secured to the outer whipstock at more than one location so that the connection therebetween is not as susceptible to inadvertent failure caused by flexing as were prior art milling tool-to-whipstock connections. Thus, these shear screws are less likely to be severed in the present invention. Additionally, the cylindrical head extending around the milling tools provides further support to prevent flexing between the outer whipstock and the milling tool.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A whipstock assembly for use within a wellbore to cut a window laterally through a casing for passing a workstring to drill a sidetrack borehole from said wellbore, said whipstock assembly comprising:

an outer whipstock having a first deflection surface for urging a first milling tool to move laterally from said first deflection surface and through said casing;

an inner whipstock having a second deflection surface for urging a second larger milling tool to move laterally from said second deflection surface and through said casing after removal of said outer whipstock from said wellbore;

whipstock coupling means for releasibly securing said outer whipstock to said inner whipstock and selectively operating to release said outer whipstock from said inner whipstock;

anchor means for securing said inner whipstock within said casing; and whipstock assembly release means for releasibly securing said whipstock assembly to said workstring and selectively operating to release said whipstock assembly from said workstring once said whipstock assembly is secured within said casing.

2. The whipstock assembly of claim 1, further comprising:

said first milling- tool having a plurality of cutting surfaces for cutting said casing to provide said window; and wherein said whipstock release means releasibly secures said first milling tool to said outer whipstock at a plurality of locations.

3. The whipstock assembly of claim 1, wherein said anchor means is releasible for releasing said inner whipstock from said casing for retrieval of said anchor means and said inner whipstock from said wellbore.

4. The whipstock assembly of claim 1, further comprising:

a cylindrical head secured to an upper portion of said outer whipstock for securing said outer whipstock to said workstring for retrieval of said outer whipstock from said wellbore.

5. The whipstock assembly of claim 1, further comprising:

a means for blocking debris to prevent said debris from lodging between said whipstock assembly and in interior surface of said casing.

6. The whipstock assembly of claim 5, wherein said means for blocking debris comprises:

an excluder member having a body which extends laterally from an exterior portion of said whipstock assembly and toward interior surface of said casing to prevent said debris from passing along said exterior portion of said whipstock assembly.

7. The whipstock assembly of claim 6, wherein said excluder further comprises:

an elastomeric strip which extends circumferentially about a portion of said inner whipstock for preventing said debris from passing along said inner whipstock and alongside of said whipstock anchor.

8. The whipstock assembly of claim 5, wherein said means for blocking debris comprises:

a barrier member secured to said outer whipstock and extending between a portion of said first deflection surface and said interior surface of said casing for defining an exterior shape of said outer whipstock to prevent said first deflection surface from pressing said debris into said interior surface when said outer whipstock is urged to move within said casing.

9. The whipstock assembly of claim 8, wherein said barrier member further comprises:

a thin-walled sleeve having an exterior surface which extends substantially parallel to said interior surface of said casing;

a millable material disposed within an interior space defined between said thin-walled sleeve and said first deflection surface of said outer whipstock; and wherein said barrier member is milled by said first milling tool during cutting of said window into said casing to define said exterior shape of said first deflection surface.

10. The whipstock assembly of claim 5, wherein said means for blocking debris comprises:

a millable barrier member which is milled during cutting of said window to define an exterior shape of a portion of said first deflection surface, and having an exterior surface which is shaped for preventing said exterior surface from wedging said debris between said first deflection surface and said interior surface of said casing when said outer whipstock is urged to move within said casing.

11. The whipstock assembly of claim 10, wherein exterior surface of said millable barrier member extends substantially parallel to said interior surface of said casing when said outer whipstock is disposed within said casing.

12. The whipstock assembly of claim 1, wherein said first deflection surface extends towards an interior of said casing with a shape which prevents said first deflection surface from urging a debris to wedge into said interior surface when said outer whipstock is urged to move uphole after said window is at least in part cut laterally through said casing.

13. The whipstock assembly of claim 12, wherein at least a portion of said first deflection surface is defined during cutting of said casing window.

14. The whipstock assembly of claim 1, wherein said whipstock coupling means comprises:

a lug and a slot connection in which said lug is shearably secured within a said slot.

15. A whipstock assembly for use within a wellbore to cut a window laterally through a casing for passing a workstring to drill a sidetrack borehole from said wellbore, said whipstock assembly comprising:

a whipstock anchor having at least one gripping surface for urging to move laterally into an interior surface of said casing to grippingly secure said whipstock anchor within said wellbore;

an outer whipstock having an uphole end for releasibly securing to said workstring, a first deflection surface which extends laterally towards said casing for urging a first milling tool through said casing, and a downhole end for releasibly securing to said whipstock anchor;

a whipstock assembly release latch having at least one member which extends between said uphole end of said outer whipstock and said workstring for selectively coupling said workstring to said whipstock assembly;

an inner whipstock having a second deflection surface which extends laterally towards said casing for urging a second milling tool into said casing, and a first end which is secured to said whipstock anchor; and a whipstock coupling for releasibly securing said outer whipstock to said inner whipstock, and transferring torque and linear force therebetween.

16. The whipstock assembly of claim 15, further comprising:

said first milling tool having a plurality of cutting surfaces for cutting said casing to provide said window; and wherein said whipstock assembly release latch releasibly secures said first milling tool to said outer whipstock at a plurality of locations for releasibly securing said whipstock assembly to said workstring for lowering at least part of said whipstock assembly into said wellbore.

17. The whipstock assembly of claim 15, further comprising:

a cylindrical head secured to an upper portion of said outer whipstock for latching a spear thereto for securing said outer whipstock to said workstring for retrieval of said outer whipstock from said wellbore.

18. The whipstock assembly of claim 15, wherein said whipstock anchor is selectively releasible to release said at least one gripping surface from grippingly securing said whipstock anchor within said wellbore.

19. The whipstock assembly of claim 18, wherein said whipstock anchor comprises:

a slip gripping mechanism having a slip seat and a plurality of slips which extend longitudinally along said slip seat for providing said at least one gripping surface which is urged to laterally extend into an interior surface of said casing to grippingly engage said interior surface of said casing and thus secure said whipstock assembly within said casing; and release means for releasing said slip seat to move relative to said plurality of slips for releasing said slips from grippingly engaging said interior surface of said casing and thus release said whipstock assembly for retrieval from said wellbore.

20. The whipstock assembly of claim 15, further comprising:

an excluder member having a body which circumferentially extends from an exterior portion of said whipstock assembly and laterally toward said casing to prevent debris from passing along said exterior portion of said whipstock assembly.

21. The whipstock assembly of claim 15, further comprising:

a barrier member secured to said outer whipstock and extending between a portion of said first deflection surface and said interior surface of said casing for defining an exterior shape of said whipstock to prevent said first deflection surface from pressing debris into said interior surface when said outer whipstock is urged to move within said casing.

22. The whipstock assembly of claim 21, wherein said barrier member further comprises:

a thin-walled sleeve having an exterior surface which extends substantially parallel to said interior surface of said casing;

a millable material disposed within an interior space defined between said thin-walled sleeve and said first deflection surface of said outer whipstock; and wherein said barrier member is milled by said first milling tool during cutting of said window into said casing to define said exterior shape of said first deflection surface.

23. The whipstock assembly of claim 15, further comprising:

a millable barrier member which is milled during cutting of said window to define an exterior shape of a portion of said first deflection surface, and having an exterior surface which is shaped for preventing said exterior surface from wedging debris between said first deflection surface and said interior surface of said casing when said outer whipstock is urged to move within said casing.

24. The whipstock assembly of claim 23, wherein exterior surface of said millable barrier member extends substantially parallel to said interior surface of said casing.

25. The whipstock assembly of claim 15, wherein said first deflection surface extends towards an interior of said casing with a shape which prevents said first deflection surface from urging debris to wedge into said interior surface when said outer whipstock is urged to move uphole after said window is at least in part cut laterally through said casing.

26. The whipstock assembly of claim 25, wherein at least a portion of said first deflection surface is defined during cutting of said casing window.

27. The whipstock assembly of claim 15, wherein said whipstock coupling comprises:

a torque lug which extends between said outer and inner whipstocks for slidably securing within a slot in one of said outer and inner whipstocks to releasibly secure said inner and outer whipstocks for transferring said torque therebetween; and at least one shear pin for releasibly securing said torque lug within said slot for transferring said linear force below a predetermined force threshold between said outer and inner whipstocks.

28. A whipstock assembly for use within a wellbore to cut a window laterally through a casing for passing a workstring to drill a sidetrack borehole from said wellbore, said whipstock assembly comprising:

a first milling tool having a plurality of cutting surfaces for cutting said casing to provide said window, and which includes a threaded end for securing said first milling tool to said workstring;

a whipstock anchor for releasibly securing said whipstock assembly within said casing;

an inner whipstock having a second deflection surface which extends laterally towards said casing for urging a second milling tool into said casing, a first end which is secured to said whipstock anchor, and at least one slot formed into a surface of said inner whipstock;

an outer whipstock having an uphole end for releasibly securing to said workstring, a first deflection surface which extends laterally towards said casing for urging said first milling tool into said casing, and a downhole end having at least one lug extending therefrom and into said at least one slot for releasibly securing said outer whipstock to said inner whipstock and said whipstock anchor;

a whipstock assembly release latch having at least one member which extends between said uphole end said outer whipstock and said first milling tool to secure said whipstock assembly to said workstring until said whipstock assembly release latch is selectively operated to release said workstring from said whipstock assembly;

at least one release shear pin for releasing said at least one lug to traverse within said at least one slot at a predetermined force threshold for releasing said outer whipstock from said inner whipstock for retrieval of said outer whipstock from said wellbore while said inner whipstock remains secured within said wellbore;

a cylindrical head secured to an upper portion of said outer whipstock and having a retrieval shoulder for latching a spear thereto for securing said outer whipstock to said workstring for retrieval of said outer whipstock from said wellbore;

an excluder member having a body which circumferentially extends from an exterior portion of said whipstock assembly and laterally toward said casing to prevent said debris from passing along said exterior portion of said whipstock assembly;

a thin-walled sleeve secured about a portion of said first deflection surface, and having an exterior surface which extends substantially parallel to an interior surface of said casing for defining an exterior shape of said first deflection surface to prevent said first deflection surface from pressing said debris laterally toward said interior surface of said casing when said outer whipstock is urged to move within said wellbore; and a millable material disposed within an interior space between said thin-walled sleeve and said first deflection surface, and which is milled by said first milling tool during cutting of said window into said casing to at least in part define said exterior shape of said first deflection surface.

29. A method for cutting a window laterally through a casing within a wellbore for passing a workstring through said window to drill a sidetrack borehole from said wellbore, said method comprising the steps of:

securing an inner whipstock to a whipstock anchor;

securing a downhole end of an outer whipstock to said inner whipstock by a whipstock coupling which will release said outer whipstock from said inner whipstock at a preselected force threshold;

securing an uphole end of said outer whipstock to a workstring with a release latch which is selectively operable to release said outer whipstock from said workstring;

lowering said whipstock anchor, said inner whipstock, and said outer whipstock within said wellbore to a selected wellbore depth at which said wellbore is to be sidetracked;

setting said whipstock anchor at said selected depth within said wellbore to grippingly engage said casing and support said inner whipstock within said wellbore;

selectively operating said release latch to release said workstring from said outer whipstock;

starting said window into said casing by rotating a first milling tool and lowering said first milling tool into said outer whipstock, which urges said first milling tool to cut through a wall of said casing;

operating said whipstock coupling to release said outer whipstock from said inner whipstock and removing said outer whipstock from said wellbore;

lowering a second milling tool downhole within said wellbore; and completing said window by rotating and lowering said second milling tool into said inner whipstock, which urges said second milling tool laterally through said casing.

30. The method of claim 29, further comprising the steps of:

securing said first milling tool to said upper end of said outer whipstock with said release latch;

securing said first milling tool to said workstring; and running said first milling tool within said wellbore with said outer whipstock and said inner whipstock.

31. The method of claim 30, further comprising the step of:

retrieving said outer whipstock from said wellbore with said first milling tool.

32. The method of claim 29, further comprising the step of:

providing said first deflection surface with an exterior shape which extends into an exterior surface disposed substantially parallel to an interior surface of said casing for preventing said first deflection surface from pressing a debris into said interior surface of said casing when said outer whipstock is urged to moved uphole within said casing.

33. The method of claim 29, further comprising the step of:

forming an exterior shape of said first deflection surface during cutting of said window into said casing, wherein said exterior shape provides an exterior surface which prevents said first deflection surface from pressing a debris into an interior surface of said casing when said outer whipstock is urged to move uphole within said wellbore.

* * * * *